US006155935A

United States Patent [19]

Maruko

[11] Patent Number: 6,155,935

[45] Date of Patent: Dec. 5, 2000

[54] GOLF BALL

[75] Inventor: Takashi Maruko, Chichibu, Japan

[73] Assignee: Bridgestone Sports Co., Ltd., Tokyo, Japan

[21] Appl. No.: 09/294,910

[22] Filed: Apr. 20, 1999

[30] Foreign Application Priority Data

Apr. 20, 1998 [JP] Japan ..... 10-125266

[51] Int. Cl.[7] ..... A63B 37/06

[52] U.S. Cl. ..... 473/361; 473/361; 473/365; 473/370; 473/374; 473/376; 473/377

[58] Field of Search ..... 473/361, 365, 473/370, 374, 376, 377

[56] References Cited

U.S. PATENT DOCUMENTS

| | | | |
|---|---|---|---|
| 697,925 | 4/1902 | Kempshall . | |
| 698,516 | 4/1902 | Kempshall . | |
| 700,658 | 5/1902 | Kempshall . | |
| 1,885,448 | 11/1932 | Jones . | |
| 2,055,326 | 9/1936 | Young . | |
| 2,364,955 | 12/1944 | Diddel . | |
| 2,376,085 | 5/1945 | Redford et al. . | |
| 5,439,227 | 8/1995 | Egashira et al. . | |
| 5,490,674 | 2/1996 | Hamada et al. . | |
| 5,692,973 | 12/1997 | Dalton . | |
| 5,813,923 | 9/1998 | Cavallaro | 473/373 |
| 5,820,485 | 10/1998 | Hwang | 473/361 |
| 5,836,834 | 11/1998 | Masatani et al. . | |
| 5,886,103 | 3/1999 | Bellinger | 525/179 |

FOREIGN PATENT DOCUMENTS

| | | |
|---|---|---|
| 9-285565 | 1/1997 | Japan . |
| 2317834A | 7/1996 | United Kingdom . |

*Primary Examiner*—Stephen F. Gerrity
*Assistant Examiner*—Paul D. Kim
*Attorney, Agent, or Firm*—Sughrue, Mion, Zinn, MacPeak & Seas, PLLC

[57] ABSTRACT

In a golf ball comprising a core, an intermediate layer, and a cover, the core is formed primarily of polybutadiene rubber, the intermediate layer is formed primarily of a resin having an Izod impact strength of at least 50 J/m and provided on its outer surface with a plurality of recesses, and the cover is provided on its inner surface with a plurality of protrusions. The resin of which the cover is made has a higher Shore D hardness and a lower melting point than the intermediate layer-forming resin. Due to the embedment of the protrusions in the recesses, the golf ball has improved performance.

11 Claims, 1 Drawing Sheet

GOLF BALL

This invention relates to a golf ball comprising a core, an intermediate layer, and a cover. More particularly, it relates to such a golf ball in which the intermediate layer and the cover are respectively provided with recesses and protrusions for achieving increased distance and good "feel."

BACKGROUND OF THE INVENTION

A variety of studies and proposals have been made to find a good compromise between flight distance and "feel" of golf balls. For solid golf balls comprising a solid core and a cover, one common approach is to construct the core and the cover into multilayer structures for adjusting their hardness and dimensions (including diameter and gage).

For example, U.S. Pat. No. 5,439,227 discloses a three-piece golf ball comprising a core, a cover inner layer and a cover outer layer, the cover outer layer being harder than the cover inner layer. U.S. Pat. No. 5,490,674 discloses a three-piece golf ball comprising a solid core of inner and outer layers and a cover, the core inner layer being harder than the core outer layer.

While the respective layers of most golf balls define smooth spherical surfaces, the golf balls disclosed in U.S. Pat. Nos. 2,376,085 and 5,692,973 have a core which is provided with outwardly extending protrusions for preventing the core from being offset during injection molding of the cover therearound. The protrusions in these golf balls are substitutes for the support pins used during injection molding. These patents do not attempt to positively utilize the shape effect of support pin-substituting protrusions, but rather intend to avoid incorporation of a distinct material in the cover by forming the protrusions from the same material as the cover.

Recently, JP-A 285565/1997 proposes a two-piece solid golf ball in which the solid core and cover, or adjoining layers of a multilayer solid core or adjoining layers of a multilayer cover are provided with irregularities. When hit, the ball gives a different feel to the player, depending on the direction of external force applied to the ball. This golf ball is improved in feel, but insufficient in flight performance and durability. There is room for further improvement.

SUMMARY OF THE INVENTION

An object of the invention is to provide a golf ball comprising a core, an intermediate layer and a cover wherein the cover on the intermediate layer side is provided with a plurality of protrusions, thereby achieving improved durability, outstandingly increased carry upon full shots with a driver, and desired control and tight feel upon shots with a short iron.

It is well known from the study of strength of materials that a beam supporting an axial compressive load gives rise to the buckling phenomenon that as the load increases, uniform compression becomes unstable and is shifted laterally whereby the beam is bent. The invention has been made by applying the buckling phenomenon to a golf ball. Specifically, when columns or protrusions of different hardness are distributed in a surface-adjoining region of a ball undergoing a large amount of deformation, specifically the intermediate layer, the behavior of vertical and horizontal components of the deformation that the ball undergoes upon impact is made different from conventional balls. Then the dependency on club of initial conditions (especially spin rate) of the ball can be adjusted as desired.

The invention provides a golf ball comprising a core of at least one layer, an intermediate layer around the core, and a cover of at least one layer around the intermediate layer. The core is formed primarily of polybutadiene rubber. The intermediate layer is formed primarily of a resin having an Izod impact strength of at least 50 J/m and provided on its outer surface with a plurality of recesses. The cover is provided on its inner surface with a corresponding plurality of inwardly extending protrusions fitting in the recesses in the intermediate layer. A cross section of the protrusions at their base has a size which is smaller than the thickness of the intermediate layer. The cover is formed primarily of a resin, and the Shore D hardness of the cover-forming resin is at least 8 units higher than the Shore D hardness of the intermediate layer-forming resin, and the melting point of the cover-forming resin is lower than the melting point of the intermediate layer-forming resin. This construction where the protrusions on the cover penetrate into the intermediate layer where stresses concentrate when the ball is hit has the following advantages. For driver shots, due to the relationship between a high head speed and a small loft angle, the impact force has a greater vertical component relative to the club face so that the cover protrusions embedded within the intermediate layer give rise to a buckling phenomenon (the ball is liable to collapse). This in turn provides a reduced spin rate and an increased launch angle, resulting in a drastically increased carry. For short iron shots, due to the loft angle, the impact force has a greater horizontal component relative to the club face. Since the cover protrusions within the intermediate layer do not give rise to a buckling phenomenon except for the vertical component, satisfactory spin performance is obtained. That is, ease of control is maintained and a tight, full-body feel is obtained. Furthermore, since the cover can be formed so that its protrusions may be precisely embedded in the recesses in the intermediate layer, a tight joint is established between the intermediate layer and the cover, resulting in improved durability.

Preferably the core is made relatively large to a diameter of 28 to 38 mm, the intermediate layer has a thickness of 1 to 6 mm, and the cover excluding the protrusions has a thickness of 0.5 to 2.5 mm. Also preferably, the intermediate layer-forming resin has a Shore D hardness of 15 to 55, and the cover-forming resin has a Shore D hardness of 45 to 70. Further preferably, the intermediate layer-forming resin contains a polyester resin as a main component, and the cover-forming resin contains an ionomer resin as a main component.

BRIEF DESCRIPTION OF THE DRAWING

The sole FIGURE.

DESCRIPTION OF PREFERRED EMBODIMENTS

Figure 1:
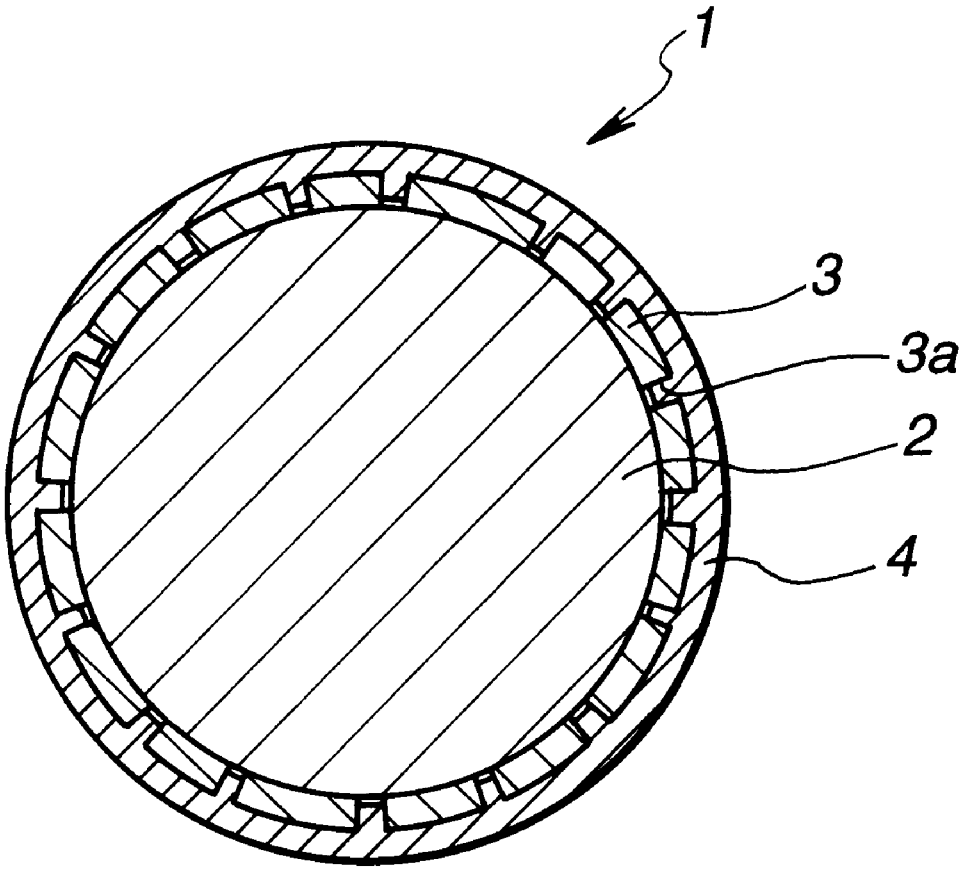
FIG. 1 is a schematic cross-sectional view of a golf ball according to one embodiment of the invention.

Referring to FIG. 1, a multilayer golf ball according to one embodiment of the invention, designated at 1, is illustrated as comprising a solid core 2, an intermediate layer 3 enclosing the core 2, and a cover 4 enclosing the intermediate layer. The core 2 and cover 4 each may consist of either a single layer or plural layers. All these components are disposed in a concentric fashion.

The solid core 2 is formed of a rubber composition primarily comprising a base rubber containing polybutadiene as a main component. The polybutadiene used herein is preferably 1,4-cis-polybutadiene containing at least 40% of cis structure. In the base rubber, another rubber component such as natural rubber, polyisoprene rubber or styrene-butadiene rubber may be blended with the polybutadiene if desired. For high resilience, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc acrylate, and esters such as trimethylpropane methacrylate. Of these, zinc acrylate is preferred because it can impart high resilience. The crosslinking agent is preferably used in an amount of about 15 to 40 parts by weight per 100 parts by weight of the base rubber. A vulcanizing agent may also be blended, preferably in an amount of about 0.1 to 5 parts by weight per 100 parts by weight of the base rubber. In the rubber composition, zinc oxide or barium sulfate may be blended as an antioxidant or specific gravity adjusting filler. The amount of filler blended is preferably about 5 to 130 parts by weight per 100 parts by weight of the base rubber.

One preferred formulation of the solid core-forming rubber composition is given below.

| | Parts by weight |
|---|---|
| Cis-1,4-polybutadiene | 100 |
| Zinc oxide | 5 to 40 |
| Zinc acrylate | 15 to 40 |
| Barium sulfate | 0 to 40 |
| Peroxide | 0.1 to 5.0 |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

The solid core 2 is preferably made relatively large to a diameter of 28 to 38 mm, more preferably 30 to 37 mm. With a core diameter of less than 28 mm, it would be difficult to position the intermediate layer having protrusions penetrated therein near the surface-adjoining region of a ball where stresses concentrate upon impact. A core diameter of more than 38 mm would require the thickness of the intermediate layer and cover to be reduced. In either case, the benefits of the invention are not always obtained.

Preferably the core has a Shore D hardness of 20 to 50, more preferably 25 to 45, and a deflection under a load of 100 kg of 2.5 to 5.0 mm, more preferably 3.0 to 4.5 mm. The weight of the core is usually about 12 to about 35 grams.

The core is usually formed to a single layer structure from one material although it may also be formed to a multilayer structure of two or more layers of different materials if desired.

The intermediate layer is formed primarily of a resin having a relatively high Izod impact strength of at least 50 J/m. Exemplary resins include polyester resins, polyester elastomers, ionomer resins, styrene elastomers, hydrogenated butadiene rubber and mixtures thereof, with the polyester resins being preferred. Use may be made of commercially available polyester resins such as Hytrel 3078, 4047, and 4767 from Toray Dupont K.K.

Izod impact strength is measured according to JIS K-7110. The resin should have an Izod impact strength of at least 50 J/m, preferably from 100 J/m to less than the value at failure. The Izod impact strength of less than 50 J/m is undesirable because the durability of the ball against shots is lost.

Preferably the intermediate layer-forming resin has a Shore D hardness of 15 to 55, more preferably 20 to 50, and a melting point of 120 to 220° C., more preferably 140 to 200° C. The intermediate layer preferably has a thickness of 1 to 6 mm, more preferably 1.5 to 5 mm.

The intermediate layer is formed around the core by conventional injection or compression molding. Preferably the intermediate layer at its outer surface is provided with a plurality of recesses at the same time as it is molded. Specifically, the cavity of a mold for forming the intermediate layer is formed on its inner surface with a plurality of protrusions corresponding to the plurality of recesses. This mold enables the intermediate layer having a plurality of recesses in its outer surface to be formed by conventional injection molding. In some cases, after a smooth intermediate layer is formed around the core, recesses can be formed in the intermediate layer by engraving, drilling or any other means. While the recesses are formed, the remaining area of the intermediate layer defines a substantially spherical or convex outer surface.

According to the invention, the cover material is molded around the intermediate layer having a plurality of recesses in its outer surface by conventional injection or compression molding, whereby the cover having protrusions embedded in the intermediate layer is formed.

Any of well-known cover stocks may be used in forming the cover 3. The cover material may be selected from ionomer resins, polyurethane resins, polyester resins and balata rubber. Use may be made of commercially available ionomer resins such as Surlyn (du Pont) and Himilan (Mitsui Dupont Polychemical K.K.).

Additives such as titanium dioxide and barium sulfate may be added to the cover stock for adjusting the specific gravity and other properties thereof. Other optional additives include UV absorbers, antioxidants, and dispersants such as metal soaps. The cover may have a single layer structure of one material or be formed to a multilayer structure from layers of different materials.

The cover excluding the protrusions (embedded in the recesses in the intermediate layer) preferably has a thickness of 0.5 to 2.5 mm, more preferably 1.0 to 2.0 mm. The cover resin preferably has a Shore D hardness of 45 to 70, more preferably 50 to 65 and a melting point of 60 to 150° C., more preferably 70 to 120° C.

Referring to FIG. 1, the intermediate layer 3 is provided with a plurality of recesses 3*a*. The cover layer 4 penetrates into the recesses 3*a* to form protrusions therein. The total number of recesses in the outer surface of the intermediate layer is usually about 80 to about 500, preferably about 90 to about 400. The recesses are uniformly distributed on the spherical outer surface of the intermediate layer, preferably in a regular arrangement, for example, a regular octahedral or regular icosahedral arrangement as is well known for the dimple arrangement. The recesses preferably have a depth of 1.0 to 6.0 mm, more preferably 1.5 to 5.0 mm. The depth of recesses is equal to the length of protrusions. The shape of recesses is not critical and they may be formed to an appropriate shape such as a cylinder, cone, prism, pyramid, frusto-cone or frusto-pyramid.

The Shore D hardness of the cover resin forming the protrusions is higher than the Shore D hardness of the intermediate layer-forming resin. The hardness difference is at least 8 Shore D units, preferably 10 to 50 Shore D units. With a hardness difference of less than 8 Shore D units, the boundaries between the protrusions and the recesses become less definite so that the penetrating effect of protrusions becomes weak.

The melting point of the cover resin forming the protrusions is lower than the melting point of the intermediate layer-forming resin. The melting point difference is preferably at least 10° C., more preferably 30 to 150° C. A melting point difference of less than 10° C. allows the intermediate layer to be melted during molding of the cover thereon, sometimes failing to configure the protrusions accurately to the desired shape.

The protrusions each have a top and a base, and the cross section of the protrusions at their base may have a circular, triangular, rectangular or other shape. The size of the cross section of the protrusions at their base, which is a diameter for the circular planar shape, the longest side for the triangular planar shape, or the longest diagonal for the rectangular and other planar shapes, is preferably 0.5 to 5.0 mm, more preferably 1.0 to 4.0 mm. This cross-section size is preferably not more than 95%, preferably 10 to 90% of the thickness of the intermediate layer. If the protrusion cross-section size is more than 95% of the intermediate layer thickness, the protrusions would become less liable to buckling, failing to achieve the effect of the invention.

As described above, the golf ball of the invention has the intermediate layer provided with a plurality of recesses and the cover not only enclosing the intermediate layer, but also penetrating into the recesses to form protrusions in fit therewith wherein the resinous material of the cover including the protrusions is harder than the resinous material of the intermediate layer having a relatively high impact strength as demonstrated by an Izod impact strength of at least 50 J/m. When hit with a driver at a relatively high head speed, the ball undergoes a considerable deformation because the cover protrusions in the intermediate layer undergoes a buckling phenomenon. Owing to a reduced backspin rate and an increased launch angle, the ball travels a markedly increased carry.

When hit with a short iron at a relatively low head speed, the ball undergoes small deformation because the cover protrusions in the intermediate layer does not buckle. Due to an increased backspin rate, the ball is easy to control. With respect to the "feel" of the ball when hit, the ball gives a feel in proportion to the amount of deformation, that is, a soft pleasant feel on driver shots and a tight full-body feel on short iron shots.

The golf ball of the invention as a whole preferably has a hardness corresponding to a deflection of 2.6 to 4.0 mm, more preferably 2.8 to 3.8 mm, under a load of 100 kg. The golf ball must have a diameter of not less than 42.67 mm and a weight of not greater than 45.93 grams in accordance with the Rules of Golf.

Since the intermediate layer is provided with a plurality of recesses and the cover penetrates into the recesses to form protrusions, the golf ball of the invention provides a soft feel and an increased carry on driver shots and ease of control and a tight full-body feel on short iron shots.

EXAMPLE

Examples of the invention are given below by way of illustration and not by way of limitation.

Examples 1–5 & Comparative Examples 1–4

Solid cores A to G were formed by working rubber compositions of the formulation shown in Table 1 in a kneader and molding and vulcanizing them in molds at a temperature of 155° C. for about 15 minutes. Intermediate layers were formed around the cores by injection molding resin compositions of the formulation shown in Table 2. The combination of core and intermediate layer is shown in Table 3. The intermediate layer-forming molds used in Examples 1–5 and Comparative Examples 1–2 had cylindrical protrusions distributed on their cavity-defining inner surface in a regular octahedral arrangement. The number, base cross-section size (diameter) and length of the protrusions on the intermediate layer-forming mold correspond to those of protrusions on the cover and are reported in Table 3.

Covers were formed around the intermediate layers by injection molding cover stocks of the formulation shown in Table 2. The combination of cover with other components is shown in Table 3. Conventional paint was applied to the covers, obtaining three-piece golf balls of Examples 1–5 and Comparative Examples 1–4.

These golf balls were examined for hardness, flight performance and feel by the following tests. The results are shown in Table 4.

Ball hardness

Hardness is expressed by a deflection (mm) under a load of 100 kg.

Flight performance

Using a swing robot, the golf ball was struck with different clubs at different head speeds (HS). A spin rate, initial velocity, carry, and roll were measured.

(1) driver (W#1), HS 45 m/s (2) driver (W#1), HS 35 m/s (3) No. 5 iron (I#5), HS 39 m/s (4) No. 9 iron (I#9), HS 35 m/s The driver club used was Tour Stage X100 with a loft angle of 10°, and the iron club was Tour Stage X1000, both available from Bridgestone Sports Co., Ltd.

Feel

The balls were hit by three professional golfers using a driver and pitching wedge. The feel of the balls upon impact was rated by the golfers according to the following criteria.

Exc.: excellent feel

Good: good feel

Fair: ordinary feel

Poor: unpleasant feel

TABLE 1

| Rubber compound (pbw) | Core A | B | C | D | E | F | G |
|---|---|---|---|---|---|---|---|
| JSR BR01*[1] | 100.0 | 100.0 | 100.0 | 100.0 | 100.0 | 100.0 | 100.0 |
| Zinc acrylate | 20.0 | 25.0 | 25.0 | 20.0 | 25.0 | 25.0 | 20.0 |
| Zinc oxide | 10.0 | 10.0 | 10.0 | 10.0 | 10.0 | 10.0 | 10.0 |
| Barium sulfate | 17.4 | 15.2 | 10.1 | 10.2 | 14.5 | 7.5 | 50.8 |
| Dicumyl peroxide | 1.2 | 1.2 | 1.2 | 1.2 | 1.2 | 1.2 | 1.2 |

*[1]polybutadiene rubber by Nippon Synthetic Rubber K.K.

TABLE 2

| Resin blend (pbw) | Intermediate layer/Cover 1 | 2 | 3 | 4 | 5 |
|---|---|---|---|---|---|
| Hytrel 3078*[2] | 100 | — | — | — | — |
| Hytrel 4047*[2] | — | 100 | — | — | — |
| Hytrel 4767*[2] | — | — | 100 | — | — |
| Himilan 1605*[3] | — | — | — | 50 | — |
| Himilan 1650*[3] | — | — | — | — | 40 |
| Himilan 1706*[3] | — | — | — | 50 | — |
| Surlyn 8120*[4] | — | — | — | — | 60 |
| Titanium oxide | — | — | — | 5 | 5 |
| Izod impact strength (J/m) | NB | NB | 154 | — | — |

NB: not broken

*[2]polyester base thermoplastic elastomer by Toray Dupont K.K.

*[3]ionomer resin by Mitsui Dupont Polychemical K.K.

*[4]ionomer resin by E. I. duPont

TABLE 3

| | | Example | | | | | Comparative Example | | | |
|---|---|---|---|---|---|---|---|---|---|---|
| | | 1 | 2 | 3 | 4 | 5 | 1 | 2 | 3 | 4 |
| Core | Compound | A | B | C | D | E | F | G | A | B |
| | Diameter (mm) | 30.5 | 30.5 | 35.3 | 36.3 | 28.3 | 35.3 | 30.5 | 30.5 | 35.3 |
| | Weight (g) | 17.5 | 17.5 | 26.4 | 28.4 | 13.9 | 26.1 | 20.2 | 17.5 | 26.4 |
| | Specific gravity | 1.176 | 1.176 | 1.147 | 1.134 | 1.172 | 1.132 | 1.358 | 1.176 | 1.147 |
| | Hardness (mm)*5 | 3.9 | 3.5 | 3.5 | 4.1 | 3.4 | 3.5 | 4.0 | 3.9 | 3.5 |
| Inter- | Blend | 1 | 1 | 2 | 3 | 2 | 3 | 5 | 1 | 2 |
| mediate | mp. (° C.) | 154 | 154 | 182 | 199 | 182 | 199 | 85 | 154 | 182 |
| layer | Diameter (mm)*6 | 38.5 | 38.5 | 40.3 | 40.3 | 40.3 | 40.3 | 38.5 | 38.5 | 40.3 |
| | Thickness (mm) | 4.0 | 4.0 | 2.5 | 2.0 | 6.0 | 2.5 | 4.0 | 4.0 | 2.5 |
| | Weight (g)*6 | 34.7 | 34.7 | 39.0 | 39.0 | 39.0 | 39.0 | 34.7 | 34.7 | 39.0 |
| | Specific gravity | 1.15 | 1.15 | 1.12 | 1.15 | 1.12 | 1.15 | 0.97 | 1.15 | 1.12 |
| | Hardness (shore D) | 30 | 30 | 40 | 47 | 40 | 47 | 53 | 30 | 40 |
| Cover | Blend | 4 | 5 | 5 | 4 | 5 | 5 | 4 | 4 | 5 |
| | mp. (° C.) | 90 | 85 | 85 | 90 | 85 | 85 | 90 | 90 | 85 |
| | Thickness (mm) | 2.1 | 2.1 | 1.2 | 1.2 | 1.2 | 1.2 | 2.1 | 2.1 | 1.2 |
| | Weight (g) | 10.6 | 10.6 | 6.3 | 6.3 | 6.3 | 6.3 | 10.6 | 10.6 | 6.3 |
| | Specific gravity | 0.97 | 0.97 | 0.97 | 0.97 | 0.97 | 0.97 | 0.97 | 0.97 | 0.97 |
| | Hardness (Shore D) | 62 | 52 | 52 | 62 | 52 | 52 | 62 | 62 | 52 |
| Protrusions | Number | 152 | 344 | 344 | 344 | 120 | 344 | 344 | nil | nil |
| | Base size (mm) | 1.0 | 1.5 | 1.0 | 0.5 | 2.5 | 1.0 | 1.5 | | |
| | Length (mm) | 4.0 | 4.0 | 2.5 | 2.0 | 6.0 | 2.5 | 4.0 | | |

*5deflection (mm) under a load of 100 kg
*6value for core and intermediate layer combined

TABLE 4

| | | Example | | | | | Comparative Example | | | |
|---|---|---|---|---|---|---|---|---|---|---|
| | | 1 | 2 | 3 | 4 | 5 | 1 | 2 | 3 | 4 |
| Ball | Diameter (mm) | 42.7 | 42.7 | 42.7 | 42.7 | 42.7 | 42.7 | 42.7 | 42.7 | 42.7 |
| | Weight (g) | 45.3 | 45.3 | 45.3 | 45.3 | 45.3 | 45.3 | 45.3 | 45.3 | 45.3 |
| | Hardness (mm) | 3.1 | 3.6 | 3.2 | 3.0 | 3.2 | 3.1 | 2.7 | 3.1 | 3.2 |
| W#1/HS45 | Spin (rpm) | 2760 | 2860 | 2790 | 2920 | 2690 | 3080 | 2900 | 2930 | 3140 |
| | Carry (m) | 214.9 | 216.6 | 215.7 | 215.3 | 213.1 | 212.4 | 215.2 | 212.9 | 209.0 |
| | Total (m) | 223.5 | 221.4 | 223.2 | 220.6 | 219.8 | 217.6 | 220.8 | 218.7 | 215.8 |
| | Initial velocity (m/s) | 68.1 | 68.0 | 68.1 | 68.0 | 67.9 | 68.0 | 68.0 | 68.0 | 67.9 |
| W#1/HS35 | Spin (rpm) | 4130 | 4270 | 4160 | 4360 | 4010 | 4600 | 4320 | 4360 | 4690 |
| | Carry (m) | 141.2 | 142.1 | 141.5 | 142.7 | 139.7 | 139.0 | 141.8 | 139.7 | 137.1 |
| | Total (m) | 160.4 | 159.0 | 160.2 | 158.4 | 157.2 | 155.8 | 157.7 | 156.0 | 154.3 |
| I#5/HS39 | Spin (rpm) | 6270 | 6650 | 6230 | 6590 | 6150 | 6030 | 6510 | 5900 | 6120 |
| | Carry (m) | 155.3 | 153.6 | 155.1 | 153.9 | 154.7 | 155.1 | 154.3 | 156.8 | 154.1 |
| | Total (m) | 159.7 | 156.7 | 159.0 | 156.9 | 158.9 | 160.0 | 158.1 | 163.5 | 158.8 |
| | Roll (m) | 4.4 | 3.1 | 3.9 | 3.0 | 4.2 | 4.9 | 3.8 | 6.7 | 4.7 |
| I#9/HS35 | Spin (rpm) | 9210 | 9660 | 9090 | 9570 | 9030 | 8750 | 9360 | 8200 | 8900 |
| | Carry (m) | 125.2 | 123.8 | 124.9 | 124.0 | 124.7 | 125.0 | 124.3 | 125.4 | 124.2 |
| | Total (m) | 127.2 | 124.7 | 127.1 | 125.2 | 126.4 | 127.4 | 125.6 | 131.5 | 126.5 |
| | Roll (m) | 2.0 | 0.9 | 2.2 | 1.2 | 1.7 | 2.4 | 1.5 | 6.1 | 2.3 |
| Feel | Driver | Good | Exc. | Exc. | Exc. | Fair | Good | Poor | Fair | Good |
| | Pitching wedge | Exc. | Exc. | Exc. | Exc. | Good | Poor | Fair | Poor | Poor |

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a core of at least one layer, an intermediate layer around the core, and a cover of at least one layer around the intermediate layer, wherein the core is formed primarily of polybutadiene rubber, the intermediate layer is formed primarily of a resin having an Izod impact strength of at least 50 J/m and provided on its outer surface with a plurality of recesses, the cover is provided on its inner surface with a corresponding plurality of inwardly extending protrusions fit in the recesses in the intermediate layer, a cross section of the protrusions at their base having a size which is smaller than the thickness of said intermediate layer, and the cover is formed primarily of a resin having a Shore D hardness and a melting point, the Shore D hardness of the cover-forming resin is at least 8 units higher than the Shore D hardness of the intermediate layer-forming resin, and the melting point of the cover-forming resin is lower than the melting point of the intermediate layer-forming resin.

2. The golf ball of claim 1 wherein the core has a diameter of 28 to 38 mm, said intermediate layer has a thickness of 1 to 6 mm, and said cover excluding the protrusions has a thickness of 0.5 to 2.5 mm.

3. The golf ball of claim 1 wherein the intermediate layer-forming resin has a Shore D hardness of 15 to 55, and the cover-forming resin has a Shore D hardness of 45 to 70.

4. The golf ball of claim 1 wherein the intermediate layer-forming resin contains a polyester resin as a main component, and the cover-forming resin contains an ionomer resin as a main component.

5. The golf ball of claim 1, wherein the core is solid having a diameter in the range of 30 to 37 mm.

6. The golf ball of claim 5, wherein the solid core has a Shore D hardness of 20 to 50 and a deflection under a load of 100 kg in the range of 2.5 to 5.0 mm.

7. The golf ball of claim 1, wherein the intermediate layer-forming resin has a melting point of 120 to 220° C.

8. The golf ball of claim 1, wherein the cover-forming resin has a melting point of 60 to 150° C.

9. The golf ball of claim 1, wherein a total number of recesses in the intermediate layer is in the range of 80 to 500 which are uniformly distributed on the spherical outer surface of the intermediate layer.

10. The golf ball of claim 1, wherein said protrusions have a cross-section size not more than 95% of the thickness of said intermediate layer.

11. The golf ball of claim 1, wherein the golf ball as a whole has a hardness corresponding to a deflection of 2.6 to 4.0 mm under a load of 100 kg.

* * * * *